US009685700B2

(12) United States Patent
Komulainen et al.

(10) Patent No.: US 9,685,700 B2
(45) Date of Patent: Jun. 20, 2017

(54) WAVEGUIDE STRUCTURE

(71) Applicant: Intel Corporation, Santa Clara, CA (US)

(72) Inventors: Mikko S. Komulainen, Tampere (FI); Saku Lahti, Tampere (FI)

(73) Assignee: Intel Corporation, Santa Clara ( * ) Notice: Subject to any disclaimer, the term of this patent is extended or adjusted under 35 U.S.C. 154(b) by 0 days.

(21) Appl. No.: 14/751,107

(22) Filed: Jun. 25, 2015

(65) Prior Publication Data

US 2016/0380346 A1 Dec. 29, 2016

(51) Int. Cl.
*H01Q 1/52* (2006.01)

(52) U.S. Cl.
CPC ..... *H01Q 1/521* (2013.01)

(58) Field of Classification Search
CPC . H04B 7/04; H01Q 13/22; H01Q 1/50; H01Q 1/245; H01Q 1/521
USPC ..... 381/353, 340; 455/272, 101
See application file for complete search history.

(56) References Cited

U.S. PATENT DOCUMENTS 5,732,143 A * 3/1998 Andrea ..... G10K 11/178 381/71.13
6,865,193 B2 * 3/2005 Terk ..... H04N 7/108 370/493
2016/0126637 A1 * 5/2016 Uemichi ..... H01Q 13/22 343/771
2016/0149315 A1 * 5/2016 Elsherbini ..... H04B 7/04 455/101

OTHER PUBLICATIONS

Lahti, et al., "Orientation Agnostic Millimeter-Wave Radio Link", U.S. Appl. No. 14/278,767, filed May 15, 2014, 36 pages.
Adhikari, Understanding Millimeter Wave Wireless Communication, Loea Corporation, 2008.

* cited by examiner

*Primary Examiner* — Lam T Mai
(74) *Attorney, Agent, or Firm* — Forefront IP Lawgroup of Christie and Rivera, PLLC

(57) ABSTRACT

Described herein are architectures, platforms and methods for implementing an orientation-agnostic mm-wave antenna(s) that includes an integrated second mechanism on a waveguide structure of the mm-wave antenna. The second mechanism, for example, operates on a second signal and is co-running with an operation of the waveguide structure. The second mechanism may include an audio sub-system such as an audio speaker and/or an audio microphone, or other mechanisms such as a sound or a signal detector, signal transmitter/receiver, or the like.

21 Claims, 5 Drawing Sheets

WAVEGUIDE STRUCTURE

BACKGROUND

An increasing number of wireless communication standards as applied to a portable device and a trend towards ever smaller, slimmer and lighter portable devices may cause major design challenges for antennas or antennas (hereinafter referred to as antenna in this document). Antennas represent a category of components that may fundamentally differ from other components in the portable device. For example, the antenna may be configured to efficiently radiate in free space, whereas the other components are more or less isolated from their surroundings.

Antennas operating at millimeter wave (mm-wave) frequencies—for high data rate short range links—are expected to gain popularity in near future. One example of such system is called wireless WiGig, which operates at 60 GHz frequency band and utilizes a waveguide structure for transmission or reception of radio frequency (RF) signals at this operating frequency. Current antenna designs for mm-wave wireless communications in mobile devices (such as laptop computers, tablets, smartphones, etc.) are structured to be physically isolated from other circuitries or components within the same mobile device. As such, there is a need to improve space savings within the mobile device by overcoming the effects of these current antenna designs.

BRIEF DESCRIPTION OF THE DRAWINGS

The detailed description is described with reference to accompanying figures. In the figures, the left-most digit(s) of a reference number identifies the figure in which the reference number first appears. The same numbers are used throughout the drawings to reference like features and components.

DETAILED DESCRIPTION

Figure 1:
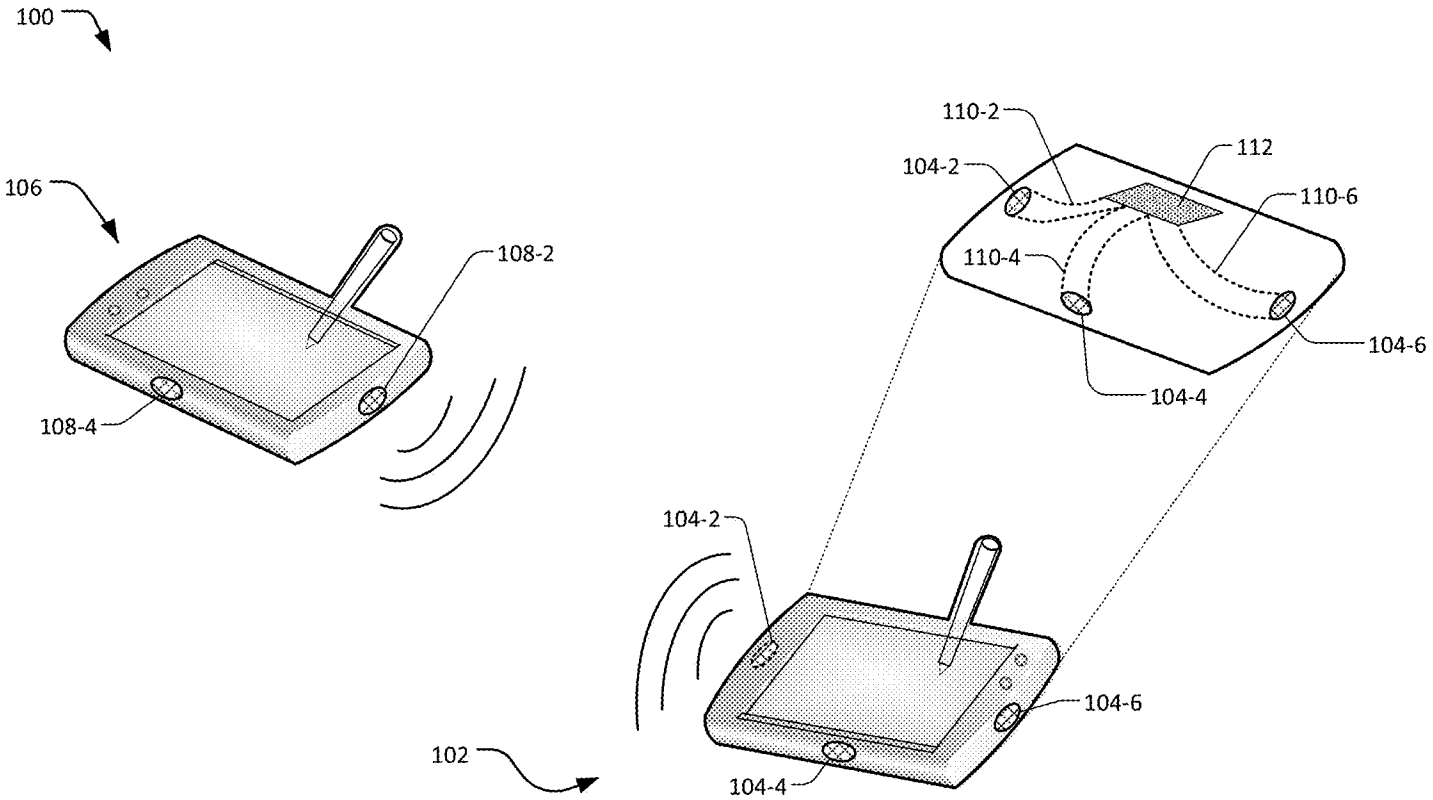
FIG. 1 is an example arrangement of millimeter-wave (mm-wave) portable devices during a mm-wave wireless communications as described in present implementations herein.

Described herein are architectures, platforms and methods for implementing an orientation-agnostic mm-wave antenna(s) with an integrated second mechanism that utilizes a different frequency or signal. For example, the portable device includes a waveguide structure that is treated as a first mechanism used as a medium for transmitting and/or receiving radio frequency (RF) signals such as mm-wave RF signals or mm-wave frequencies. In this example, the second mechanism may be integrated and further utilizes dimensions of the waveguide structure without, however, affecting the operation of the co-running first mechanism.

As an example implementation described herein, the second mechanism may include an audio sub-system such as an audio speaker and/or an audio microphone, or other mechanisms such as a sound or a signal detector, signal transmitter/receiver, or the like. The audio sub-system, for example, includes a casing or housing that is attached to an outer perimeter of the waveguide structure of the mm-wave antenna. In this example, one or more audio feed holes, which include a diameter that is significantly less than a wavelength of the mm-wave RF signal, are constructed in the waveguide structure to facilitate receiving or transmitting of audio signals. Typically the size of the audio feed holes and separation between them should be in range of $\lambda/6$ to $\lambda/10$ or smaller, in order to not impact to RF signal propagating in the waveguide. $\lambda$ denotes here wavelength of the RF signal. As a result, the waveguide may facilitate transmission and reception of the audio signal and the mm-wave RF signals at the same time.

To prevent or substantially minimize coupling between the second mechanism and the first mechanism, the audio feed holes are configured to include diameters that are lesser than the wavelength of the mm-wave RF signal. Furthermore, an electronic filtering circuitry or a mechanical hardware such as a gasket or similar mechanical sealing solution may be constructed at an RF feed signal of the first mechanism and at an audio feed signal of the second mechanisms to further minimize or prevent coupling.

In another implementation where the portable device uses multi-waveguides for corresponding open-end antennas, a switching circuitry may be utilized to perform the mm-wave wireless communication in a first waveguide; transmitting and receiving sound waves from the audio microphone—second mechanism in a second waveguide; and performing signal detection—second mechanism in a third waveguide. In this latter implementation, maximum isolation between the first and second mechanisms may be implemented because different selected waveguides are utilized for different co-running operations between the first and second mechanism.

As described herein, the open-end of the waveguide structure acts as an antenna. The antenna, in this case, may be disposed in a device chassis-outer surface such as against back cover or display glass, or may be disposed in a device chassis—inner surface or within close proximity of a housing perimeter of the portable device.

While the open-end of the waveguide structure is utilized as the antenna, its other opposite end may be connected to a RF module through a RF signal transition component such as a RF connector. For example, the RF module may be disposed to a location in a printed circuit board (PCB) of the portable device. In this example, the RF connector may be mounted to the PCB in order to facilitate a transition between the waveguide structure and a transmission line on the PCB.

FIG. 1 is an example arrangement 100 of portable devices as described in present implementations herein. The portable devices, for example, utilize mm-wave waveguide structures during a line-of-sight (LOS) wireless communication. At the same time, the mm-wave waveguide structures may include an integrated second mechanism that utilizes a configured physical dimension of the mm-wave waveguide structures based on mm-wave RF signals.

The arrangement 100 shows a portable device 102 with antennas 104, and another portable device 106 with antennas 108. The arrangement 100 further illustrates a chassis of the portable device 102 with corresponding waveguides 110 for the antennas 104, and a radio frequency (RF) module 112.

The portable device 102 may include, but is not limited to, a tablet computer, a netbook, a notebook computer, a laptop computer, mobile phone, a cellular phone, a smartphone, a personal digital assistant, a multimedia playback device, a digital music player, a digital video player, a navigational device, a digital camera, and the like. The portable device 102, for example, may communicate with the other portable device 106 in a network environment. The network environment, for example, includes a cellular network configured to facilitate communications between the portable device 102 and the other portable device 106. In wider perspective, the proposed system can be similarly applied in devices not being portable. This includes any kind of device including radio frequency waveguide.

As shown, the portable device 102 is a mm-wave portable device due to its feature or capability to operate at WiGig operating frequencies. The portable device 102, for example, utilizes the antenna 104-2 in a LOS wireless communication with the other portable device 106. The LOS wireless communication, for example, is operating at frequency range 60-100 GHz where an obstruction in between the portable devices may easily reduce signal strength during the wireless communication. In the above example, the antenna 104-2 is an open-end of a waveguide structure such as the waveguide 110-2.

In an implementation, the antenna 104-2 is optimally disposed on at least one edge of the portable device 102. For example, the waveguide 110-2 may extend from the RF module 112 to a top-edge of the portable device 102. In this example, the open-end of the waveguide 110-2 is the antenna 104-2 that is configured to provide mm-wave wireless communication. Depending upon configured sensitivity of the antenna 104-2, the portable device 102 may enter into LOS wireless communication with the other portable device 106 in relatively shorter distances (e.g., ten meters).

The antenna 104-2 of the waveguide 110-2 may include different shapes and/or configurations. For example, the antenna 104-2 may have a tapered end, a horn shape, a circular shape, or a conical configuration. In this example, the different shapes and/or configuration may correspond to different radiation patterns, beam configurations, etc. For example, a horn-shaped antenna 104-2 may have a narrower beam width and higher directivity as compared to a circular-shaped antenna l04-2. In this example, other configurations such as waveguide width, waveguide length, etc. may further be considered in arriving at above conclusion.

With continuing reference to FIG. 1, the portable devices 102 and 106 may detect which one of their respective antennas are aligned with one another. For example, as shown, the portable devices 102 and 106 establish a LOS wireless communication link and thereafter detect which of their respective antennas are aligned with one another. In this example, the portable devices 102 and 106 may detect that their respective antennas 104-2 and 108-2 may have a higher signal strength as compared to their other antennas such as between the antennas 104-4 and 108-4. Thus, the portable devices 102 and 106 may activate and utilize their corresponding antennas 104-2 and 108-2 in transmitting or receiving high data rates during the LOS wireless communication. In another implementation, other forms of detection such as a use of separate antenna within the portable devices may be utilized in selecting which antennas 104 or 108 are utilized during the LOS wireless communication.

In an implementation, the RF module 112 facilitates transmission or reception of data in the form of wireless signals through the antenna 104. For example, an RF connector (not shown) couples one end of the waveguide 110-2 to a transmission line (not shown) that links to the RF module 112. In this example, the RF module 112 may utilize the waveguide 110-2 and its open-end (i.e., antenna 104-2) for transmitting or receiving the wireless signals. The RF module 112 may be assembled in a PCB while the RF connector may be mounted on the PCB.

As described in present implementations herein, a second mechanism such as an audio sub-system (not shown) or similar sub-system of the portable device 102 may be integrated into the waveguide 110 to achieve space savings on thinner portable devices. Such integration, for example, may be implemented with minimal coupling between the mm-wave RF signals in the waveguide 110 and audio frequencies from the audio sub-system.

Although the example arrangement 100 illustrates in a limited manner basic components of mm-wave wireless communications between the portable devices 102 and 106, other components such as battery, one or more processors, SIM card, etc. were not described in order to simplify the embodiments described herein. Furthermore, although the audio sub-system is described as an example second mechanism that may be integrated to the waveguide 110, other types of second mechanisms or sub-system may similarly be employed or integrated in the waveguide 110. The second mechanism may include an audio sub-system such as an audio speaker and/or an audio microphone, or other mechanisms such as a sound or a signal detector, signal transmitter/receiver, or the like. The audio sub-system, for example, includes a casing or housing that is attached to an outer perimeter of the waveguide structure of the mm-wave antenna. Additional examples include may include transceivers, such as a detector, a Bluetooth (BT) transceiver, or a near field communications (NFC) transceiver.

Figure 2:
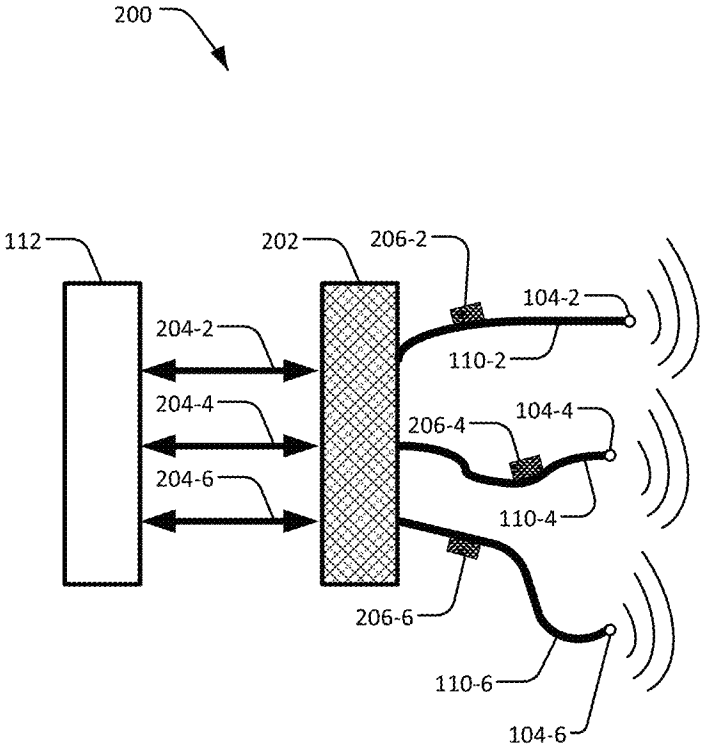
FIG. 2 is an example apparatus configured to implement mm-wave wireless communications while an integrated second mechanism is co-running with an operation of the mm-wave wireless communications.

FIG. 2 illustrates an example apparatus 200 that is configured to implement mm-wave wireless communications while a second mechanism is integrated and is co-running with an operation of the mm-wave wireless communications. As shown, the apparatus 200 includes the RF module 112, one or more RF connectors 202, transmission lines 204, the waveguides 110, the antennas 104, and second mechanisms 206.

As an example of present implementations herein, the portable device 102 may utilize multiple antennas 104 during the mm-wave wireless communications. For example, the waveguides 110 are optimally routed to different locations in the portable device 102. In this example, the respective open-ends of the waveguides 110 are utilized as the antennas 104.

The optimal routing of the waveguides 110 may be based upon: available space in the portable device 102, the location of the RF module 112, on a physical size of the antenna 104, or a desired radiation pattern or coverage of the antenna 104. For example, the waveguide 110-2 is fabricated to be shorter in length than the waveguide 110-4 because the antenna 104-2 is closer to the RF module 112 as compared to present location of the antenna 104-4. In this example, internal dimensions of the waveguide 110-2 may have a different configuration as compared to the waveguide 104-2. The reason being, the difference in waveguide lengths may correspond to different forms of reflection and signal losses within the waveguide (i.e., mm-wave signal paths).

In another example, the waveguide 110-4 is equal in length to the waveguide 110-6 because the RF module 112 is disposed in between the two waveguides, and that the available space within the portable device 102 allows mirror-like waveguide positioning layout. In this example, the internal dimensions of the waveguides 110-4 and 110-6 are the same. The reason being, the open ended waveguides 110-4 and 110-6 may be configured to resonate and radiate at the same frequency (e.g., 60 GHz). At this resonant frequency and for the same waveguide lengths, the waveguides 110-4 and 110-6 may have the same internal dimensions to transfer maximum power.

As an example of present implementations herein, the RF connector 202 is a RF signal transition component that may facilitate a transition between two different signal path mediums during transmission and reception of the mm-wave wireless signals. For example, the RF module 112 utilizes the transmission line 204 to connect to the RF connector 202. In this example, the transmission line 204 is a type of electrical transmission line medium that may be fabricated using printed circuit board (PCB) technology, and is used to convey mm-wave wireless signals. Planar transmission line may, for example, be of a microstrip line, strip line or co-planar waveguide type. Alternatively, the transmission line 204 may be of no-planar type such as co-axial or another waveguide. Furthermore, the transmission line 204 may include a conducting piece that is separated from a ground plane by a dielectric layer known as the substrate.

The transmission line 204 is connected to the RF connector 202, which is further linked to another signal path medium i.e., waveguide 110. For example, as further discussed below, the RF connector 202 may include a conductive and/or dielectric housing and a feed-point (not shown) within the housing. Usually the conductive part of the housing is connected to ground. In this example, the RF connector 202 may be mounted on the PCB and the feed-point is linked to the transmission line 204. Furthermore, the housing of the RF connector 202 may be configured to receive the other end of the waveguide 110 to complete the mm-wave signal path between the RF module 112 and the antenna 104.

With continuing reference to FIG. 2, the RF module 112 is configured to transmit or receive mm-wave wireless signals. During transmission or reception, the RF module 112 may utilize different forms of digital modulation or demodulation, signal conversion methods, etc. to transmit or receive the mm-wave wireless signals. As described above, the RF module 112 may be integrated or assembled into the PCB of the portable device 102.

FIG. 2 further illustrates the second mechanisms 206-2, 206-4, and 206-6 that are integrated to the waveguides 110-2, 110-4, and 110-6, respectively. In an implementation, the second mechanisms 204 may include an audio speaker, an audio microphone, a signal detector, a low-frequency signal transmitter and receiver, or the like. In this implementation, the dimension and/or configuration of the waveguides 110 are primarily dictated by its respective RF resonant frequency and the integration of the second mechanisms 204 is implemented with minimum coupling on the operation of the waveguides 110.

For example, the audio microphone may generally operate through a mechanical vibration or movement of sound signals (i.e., low frequency signals). In this example, the mechanical vibration typically provides minimum coupling on the mm-wave RF signal of the waveguides 110 because they are two separate and independent mode of signal modulation. As further discussed below, an isolating hardware structure such as an audio or RF sealing mechanism may be constructed and disposed in the waveguides 110 to further minimize the possible coupling between the first and second mechanisms.

Figure 3:
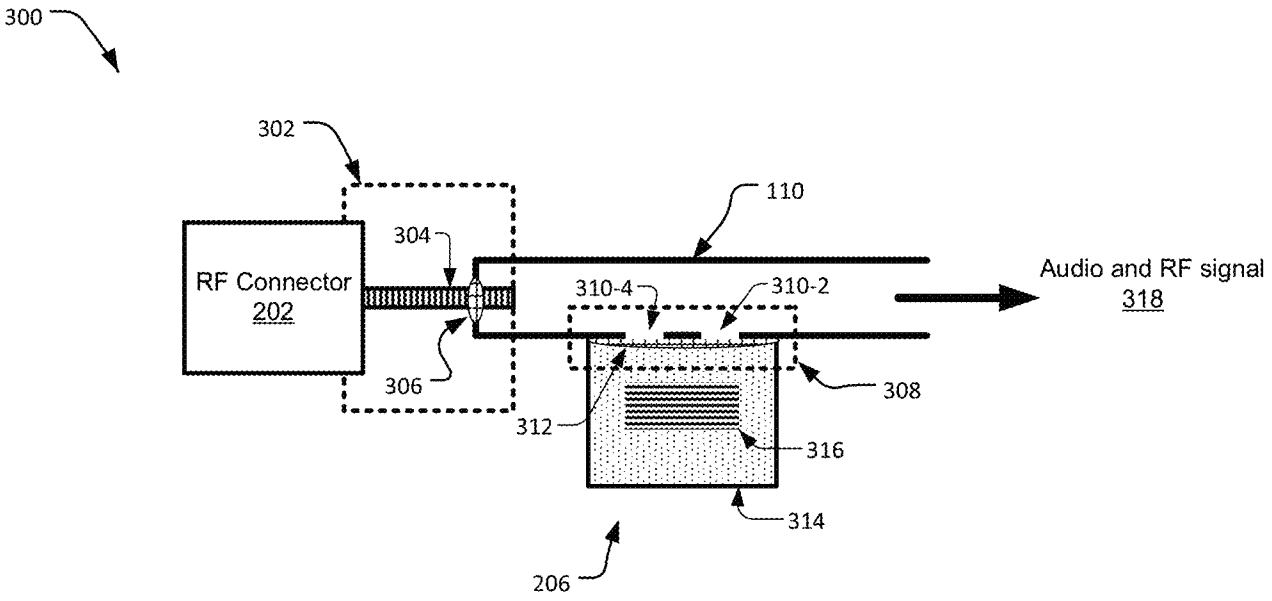
FIG. 3 is an example implementation of an integrated mechanism as described in present implementations herein.

FIG. 3 illustrates an example implementation of an integrated mechanism 300 as described in present implementations herein. The integrated mechanism 300, for example, includes the RF connector 202, an RF signal feed 302 with a feed-probe 304, an audio sealing 306 that acts as an audio isolating hardware within the RF signal feed 302, and the second mechanism 206. The second mechanism 206, for example, further includes an audio signal feed 308 with audio signal feed holes 310-2 and 310-4, an RF sealing 312 that acts as RF isolating hardware, an audio housing 314, and a microphone 316. Furthermore still, the integrated mechanism illustrates an audio and RF signal output 318 for the co-running mm-wave wireless communication and audio subsystem operation.

During the mm-wave wireless communication, the RF signal feed 302 may act as a coupling mechanic (i.e., signal coupler) between the RF connector 202 and the waveguide 110. For example, the RF signal feed 302 may include the feed-probe 304 that may be used to control the RF signal from the RF connector 202 to the waveguide 110. As discussed above, the RF connector 202 facilitates a transition signal path between two different signal path mediums. That is, the first signal path medium may include transmission line while the other signal path medium is the waveguide 110. In this case, the RF connector 202 facilitates a substantially loss-free and reflection-free signal path transition for transmitting or receiving the mm-wave wireless signals.

The feed-probe 304, for example, may be utilized to control signal parameters (e.g., power, phase, polarization, radiation pattern, etc.) of the passing mm-wave wireless signal during transmission or reception. Varying a depth of the feed-probe 304, for example, along a radiator slot (not shown) may change amount of power in the transmitted mm-wave wireless signals. In another example, the feed-probe 304 may be utilized to choose which waveguide 110 is used during the transmission or reception. For example, the feed-probe 304 may totally close the radiator slot for a particular waveguide 110. In this example, the particular waveguide 110 (with closed radiator) may not transmit or receive mm-wave wireless signals through the open-end or antenna 104 of the portable device.

As described in present implementations herein, the audio sealing 306 may include an audio frequency—filtering electronic circuitry such as a high-pass filter that attenuates low-frequency audio signals, or mechanical materials such as a gasket, which prevents or substantially minimizes coupling signals from the second mechanism 206. For example, the microphone 316 may generate mechanical vibration of sound waves along the waveguide 110. In this example, the mm-wave wireless communication operation in the waveguide 110 may not be affected by the mechanical vibration as they are different and separate mechanisms; however, to further ensure the minimized coupling, the audio sealing 306 may be installed to filter low frequency audio signals (i.e., about 15 KHz) from coupling with the waveguide 110 operation.

Similarly, the RF sealing 312 is disposed within the audio signal feed 308 to act as RF isolating hardware. For example, during the mm-wave wireless communication, the RF sealing 312 may be configured to prevent the high frequency signals from the waveguide 110 to couple with the audio signals from the second mechanism 206. In this example, the RF sealing 312 may include an electronic filtering circuitry such as a low-pass filter that attenuates high RF signals, or a mechanical material such as gasket material.

As described in present implementations herein, each of the audio signal feed holes 310-2 and 310-4 may be configured to have a much smaller area or diameter when compared to a signal wavelength of the mm-wave communication. For example, for 60 Ghz mm-wave wireless communication, the wavelength is around half centimeter. In this example, each audio signal feed hole 310 may be configured to include an area or diameter that is lesser than half centimeter.

With minimized coupling between the RF signal in the mm-wave communication (i.e., first mechanism) and the audio signals from the second mechanism 206, the audio and RF signal output 318 may be transmitted through the open end of the waveguide 110.

Although the second mechanism 206 illustrates the use of the microphone 316, an speaker component (not shown) may similarly be structured in the same manner as the microphone 316. For example, the waveguide 110 may be used to form as a sealed audio path from the speaker component to the periphery of the portable device. In this example, the dimension of the waveguide 110 may be utilized to as a back cavity to facilitate audio sound volume in the speaker system. In this example still, space savings are further enhanced in thin portable devices.

Figure 4:
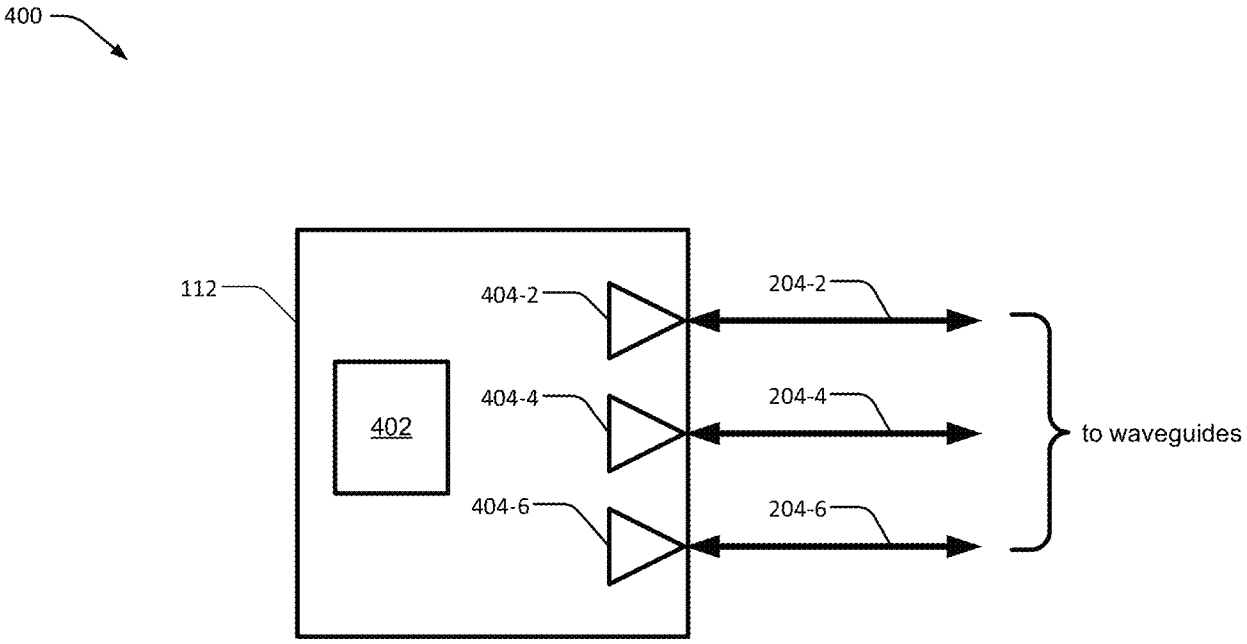
FIG. 4 is an example switching system in an RF module as described in the implementations herein.

FIG. 4 illustrates an example switching system 400 in the RF module 112 as described in the implementations herein. As shown, the switching system 400 includes a signal processor 402, amplifiers 404, and the transmission lines 204.

In an implementation, the signal processor 402 manipulates the mm-wave wireless signal to be transmitted. For example, the signal processor 402 performs analog to digital conversion, digital modulation, multiplexing, etc. on the mm-wave wireless signal that is to be transmitted through the open-ends of the waveguide 110. In this example, the signal processor 402 may further utilize a particular waveguide 110 that the signal processor 402 selects during the transmission.

The selection of the waveguide 110 may be based upon determination and comparison of different wireless signal strengths at the open-ends of the waveguide 110. In another implementation, the selection of the waveguide 110 may be based upon the type of second mechanism 206 that is integrated to each waveguide 110. For example, the first waveguide 110-2 includes an integrated audio sub-system—second mechanism 206, while another waveguide 110-2 includes an integrated sound or detector—second mechanism, or a Bluetooth (BT) transceiver—second mechanism, a near field communications (NFC) transmitter, or any other circuitry that may be integrated to the waveguide 110 without however generating substantial coupling as discussed above. In this example, coupling between the mm-wave wireless communication operation and the second mechanism operation is substantially prevented by selecting separate waveguides 110 as may be necessary for each operation. For example, the first waveguide 110-2 may be utilized for mm-wave wireless communication while another waveguide 110-4 may be utilized to receive audio signals. In this example, the selection of the first waveguide 110-2 for mm-wave wireless communication presupposes a higher signal strength that is detected in the waveguide 110-2.

Figure 5:
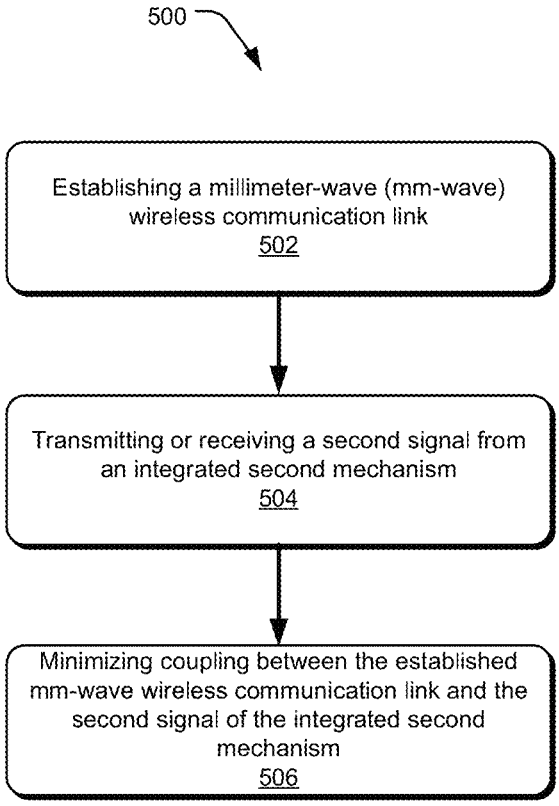
FIG. 5 is an example process chart illustrating an example method for implementing an orientation-agnostic mm-wave antenna(s) that includes an integrated second mechanism on a waveguide structure of the mm-wave antenna.

FIG. 5 shows an example process chart 500 illustrating an example method for implementing an orientation-agnostic mm-wave antenna(s) that include an integrated second mechanism on a waveguide structure of the mm-wave antenna. The second mechanism, for example, operates on a second signal and is co-running with an operation of the waveguide structure. The order in which the method is described is not intended to be construed as a limitation, and any number of the described method blocks can be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At block 502, establishing a mm-wave wireless communication link is performed. For example, a portable device (e.g., portable device 102) detects a mm-wave wireless signal. In this example, the portable device 102 may establish the mm-wave wireless communication link, for example, by sending a request-to-join an ad-hoc communication that is initiated by another portable device (e.g., portable device 106).

As described in present implementations herein, the portable device 102 includes multiple waveguides 110 with corresponding open-end antennas 104 for mm-wave wireless communication. In this implementation, the waveguide 110 and the mm-wave RF signal are treated herein as the first mechanism and first (operating) signal, respectively.

At block 504, transmitting or receiving a second signal from an integrated second mechanism is performed. For example, different second mechanisms 206 may be integrated at each waveguide 110. In this example, a switching operation/mechanism may be utilized to operate the first and/or second mechanism concurrently.

At block 506, minimizing coupling between the established mm-wireless communication link and the second signal is performed. For example, an electronic filter circuitry or a mechanical isolating material such as a gasket may be installed as audio or RF signal isolators. In another example, the RF module 112 utilizes a switching circuitry to select the waveguide 110 to use during transmitting or receiving of the mm-wave wireless signals. In this latter example, the integrated mechanism 206 that is disposed in another idle waveguide 110 may be used to avoid or substantially minimize coupling.

The following examples pertain to further embodiments:

Example 1 is a device comprising: a first mechanism comprised of a millimeter (mm) wave waveguide structure configured to transmit or receive a first signal; a second mechanism connected to the first mechanism, the second mechanism configured to radiate or receive a second signal; and an isolating hardware configured to minimize coupling between the first signal and the second signal.

In example 2, the device as recited in example 1, wherein the millimeter (mm) wave waveguide structure is comprised of a physical parameter configured to have a cut-off frequency below about 60 GHz frequency.

In example 3, the device as recited in example 1, wherein the isolating hardware comprises at least one of an audio sealing structure disposed within a radio frequency (RF) signal feed, wherein the audio sealing structure is configured to prevent the second signal from entering the RF signal feed.

In example 4, the device as recited in example 1, wherein the isolating hardware comprises an RF sealing structure disposed within an audio signal feed of the second mechanism, the RF sealing structure is configured to prevent the first RF signal from coupling with the second signal.

In example 5, the device as recited in example 1 further comprising a switch mechanism configured to select a first and a second mm-wave waveguide structure that supports the first mechanism and the second mechanism, respectively.

In example 6, the device as recited in example 1, wherein the integrated second mechanism is configured to radiate or receive the second signal through audio signal feed holes, wherein each audio signal feed hole comprises a diameter that is less than a wavelength of the first signal.

In example 7, the device as recited in example 1, wherein the isolating hardware comprises a high-pass filter and a low-pass filter.

In example 8, the device as recited in any of examples to 7, wherein the second mechanism comprises at least one of an audio microphone, an audio speaker, a signal detector, a Bluetooth (BT) transceiver, or a near field communications (NFC) transceiver.

In example 9, the device as recited in example 8, wherein the second signal from the audio microphone or the audio speaker comprises a low-frequency sound wave that generates air pressure or modulates a movement of air within the first mechanism.

In example 10, the device as recited in example 8, wherein the first and second signals are different.

Example 11 is a method of wireless communication in a portable device comprising: transmitting or receiving a first signal in a millimeter-wave (mm-wave) wireless communication link through an open-end antenna of a waveguide structure; transmitting or receiving of a second signal by a second mechanism that is integrated to the waveguide structure; and minimizing coupling between the first signal in the mm-wave wireless communication link and the second signal.

In example 12, the method as recited in example 11, wherein the transmitting or receiving of the second signal comprises transmitting or receiving of a signal from the second mechanism that comprises at least one of an audio microphone, an audio speaker, a signal detector, a Bluetooth (BT) transceiver, or a near field communications (NFC) transceiver.

In example 13, the method as recited in example 12, wherein the second signal from the audio microphone or the audio speaker comprises a low-frequency sound wave that generates air pressure or modulates a movement of air within the waveguide structure.

In example 14, the method as recited in example 11, wherein the integrated second mechanism radiates or receives the second signal through audio signal feed holes, wherein each audio signal feed hole comprises a diameter that is less than a wavelength of the first signal.

In example 15, the method as recited in any of examples 11 to 14, wherein the minimizing coupling utilizes an isolating hardware, which blocks the first signal and the second signal from coupling with an audio signal feed and a radio frequency (RF) signal feed, respectively.

Example 16 is an integrated mechanism in portable device comprising: a waveguide structure configured to propagate a first signal for millimeter-wave (mm-wave) wireless communications; a second mechanism that is integrated into the waveguide structure, wherein the second mechanism is configured to radiate or receive a second signal; and an isolating hardware configured to minimize coupling between the first signal and the second signal.

In example 17, the integrated mechanism as recited in example 16, the second mechanism comprises at least one of an audio microphone, an audio speaker, a signal detector, a Bluetooth (BT) transceiver, or a near field communications (NFC) transceiver.

In example 18, the integrated mechanism as recited in example 16, wherein the second signal from the audio microphone or the audio speaker comprises a low-frequency sound wave that generates air pressure or modulates a movement of air within the waveguide structure.

In example 19, the integrated mechanism as recited in example 16, wherein the isolating hardware comprises an audio sealing structure disposed within a radio frequency (RF) signal feed, the audio sealing structure is configured to prevent the second signal from entering the RF signal feed.

In example 20, the integrated mechanism as recited in example 16, 16, wherein the isolating hardware comprises a radio frequency (RF) sealing structure disposed within an audio signal feed of the second mechanism, the RF sealing structure is configured to prevent the first signal from coupling with the second signal.

In example 21, the integrated mechanism as recited in any of examples 16 to 20 further comprising a switch mechanism configured to select a first and a second mm-wave waveguide structure that supports the first waveguide structure and the second mechanism, respectively.

What is claimed is:

1. A device comprising:

a first mechanism comprised of a millimeter (mm) wave waveguide structure configured to transmit or receive a first signal, wherein the first signal includes one or more mm-wave radio frequency (RF) frequencies;

a second mechanism connected to the first mechanism, the second mechanism configured to radiate or receive a second signal; and an isolating hardware configured to minimize coupling between the first signal and the second signal.

2. The device as recited in claim 1, wherein the millimeter (mm) wave waveguide structure is comprised of a physical parameter configured to have a cut-off frequency below about 60 GHz frequency.

3. The device as recited in claim 1, wherein the second mechanism comprises at least one of an audio microphone, an audio speaker, a signal detector, a Bluetooth (BT) transceiver, or a near field communications (NFC) transceiver.

4. The device as recited in claim 3, wherein the second signal is sent from the audio microphone or the audio speaker, the second signal comprises a low-frequency sound wave that generates a83ir pressure or modulates a movement of air within the first mechanism.

5. The device as recited in claim 1, wherein the first signal and second signal are different.

6. The device as recited in claim 1, wherein the isolating hardware comprises an audio sealing structure disposed within a radio frequency (RF) signal feed, wherein the audio sealing structure is configured to prevent the second signal from entering the RF signal feed.

7. The device as recited in claim 1, wherein the isolating hardware comprises an RF sealing structure disposed within an audio signal feed of the second mechanism, the RF sealing structure is configured to prevent the first RF signal from coupling with the second signal.

8. The device as recited in claim 1 further comprising a switch mechanism configured to select a first and a second mm-wave waveguide structure that supports the first mechanism and the second mechanism, respectively.

9. The device as recited in claim 1, wherein the integrated second mechanism is configured to radiate or receive the second signal through a plurality of audio signal feed holes, wherein each audio signal feed hole comprises a diameter that is less than a wavelength of the first signal.

10. The device as recited in claim 1, wherein the isolating hardware comprises a high-pass filter and a low-pass filter.

11. A method of wireless communication in a portable device comprising:

transmitting or receiving a first signal in a millimeter-wave (mm-wave) wireless communication link through an open-end antenna of a waveguide structure;

transmitting or receiving of a second signal by a second mechanism that is integrated to the waveguide structure; and minimizing coupling between the first signal in the mm-wave wireless communication link and the second signal.

12. The method as recited in claim 11, wherein the transmitting or receiving of the second signal comprises transmitting or receiving a signal from the second mechanism that comprises at least one of an audio microphone, an audio speaker, a signal detector, a Bluetooth (BT) transceiver, or a near field communications (NFC) transceiver.

13. The method as recited in claim 12, wherein the second signal is sent from the audio microphone or the audio speaker comprises a low-frequency sound wave that generates air pressure or modulates a movement of air within the waveguide structure.

14. The method as recited in claim 10, wherein the integrated second mechanism radiates or receives the second signal through a plurality of audio signal feed holes, wherein each audio signal feed hole comprises a diameter that is less than a wavelength of the first signal.

15. The method as recited in claim 10, wherein the minimizing coupling using an isolating hardware, which blocks the first signal and the second signal from coupling with an audio signal feed and a radio frequency (RF) signal feed respectively.

16. An integrated mechanism in portable device comprising:

a waveguide structure configured to propagate a first signal for millimeter-wave (mm-wave) wireless communications;

a second mechanism that is integrated into the waveguide structure, wherein the second mechanism is configured to radiate or receive a second signal; and an isolating hardware configured to minimize coupling between the first signal and the second signal.

17. The integrated mechanism as recited in claim 16, the second mechanism comprises at least one of an audio microphone, an audio speaker, a signal detector, a Bluetooth (BT) transceiver, or a near field communications (NFC) transceiver.

18. The integrated mechanism as recited in claim 17, wherein the second signal is sent from the audio microphone or the audio speaker comprises a low-frequency sound wave that generates air pressure or modulates a movement of air within the waveguide structure.

19. The integrated mechanism as recited in claim 16, wherein the isolating hardware comprises an audio sealing structure disposed within a radio frequency (RF) signal feed, the audio sealing structure is configured to prevent the second signal from entering the RF signal feed.

20. The integrated mechanism as recited in claim 16, wherein the isolating hardware comprises a radio frequency (RF) sealing structure disposed within an audio signal feed of the second mechanism, the RF sealing structure is configured to prevent the first signal from coupling with the second signal.

21. The integrated mechanism as recited in claim 16 further comprising a switch mechanism configured to select a first and a second mm-wave waveguide structure that act as the waveguide structure and the second mechanism, respectively.

* * * * *